US007640156B2

(12) United States Patent
Gerrits et al.

(10) Patent No.: US 7,640,156 B2
(45) Date of Patent: Dec. 29, 2009

(54) LOW BIT-RATE AUDIO ENCODING

(75) Inventors: Andreas Johannes Gerrits, Eindhoven (NL); Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 436 days.

(21) Appl. No.: 10/564,656

(22) PCT Filed: Jul. 8, 2004

(86) PCT No.: PCT/IB2004/051172

§ 371 (c)(1),
(2), (4) Date: Jan. 13, 2006

(87) PCT Pub. No.: WO2005/008628

PCT Pub. Date: Jan. 27, 2005

(65) Prior Publication Data

US 2007/0112560 A1 May 17, 2007

(30) Foreign Application Priority Data

Jul. 18, 2003 (EP) ..... 03102225

(51) Int. Cl.
*G10L 19/00* (2006.01)

(52) U.S. Cl. ..... 704/219; 704/220; 704/221; 704/500

(58) Field of Classification Search ..... 704/219, 704/220, 221, 500
See application file for complete search history.

(56) References Cited

U.S. PATENT DOCUMENTS

| | | | | |
|---|---|---|---|---|
| RE36,478 | E * | 12/1999 | McAulay et al. | 704/206 |
| 6,292,777 | B1 * | 9/2001 | Inoue et al. | 704/230 |
| 6,493,664 | B1 * | 12/2002 | Udaya Bhaskar et al. | 704/222 |
| 6,577,995 | B1 | 6/2003 | Kim et al. | |
| 7,373,296 | B2 * | 5/2008 | Van De Par et al. | 704/226 |
| 2002/0007268 | A1 * | 1/2002 | Oomen et al. | 704/206 |
| 2002/0156619 | A1 * | 10/2002 | Van De Kerkhof et al. | 704/203 |
| 2004/0162721 | A1 * | 8/2004 | Oomen et al. | 704/203 |
| 2008/0052068 | A1 * | 2/2008 | Aguilar et al. | 704/230 |

OTHER PUBLICATIONS

A. C. Den Brinker et al: "Parametric Coding for High_Audio", Audio Engineering Society, Convention Paper 5554, 112th Convention, May 10-13 2002, Munich Germany, XP002297946.

A.C. Den Brinker et al; "Phase Transmission in a Sinusoidal Audio and Speech Coder", Audio Engineering Society Convention Paper 5983, 115th Convention, Oct. 13, 2003, New York, NY, XP009028272.

(Continued)

*Primary Examiner*—Daniel D Abebe

(57) ABSTRACT

In a sinusoidal audio encoder a number of sinusoids are estimated per audio segment. A sinusoid is represented y frequency, amplitude and phase. Normally, phase is quantised independent of frequency The invention uses a frequency dependent quantisation of phase, and in particular the low frequencies are quantised using smaller quantisation intervals than at higher frequencies. Thus, the unwrapped phases of the lower frequencies are quantised more accurately, possibly with a smaller quantisation range, than the phases of the higher frequencies. The invention gives a significant improvement in decoded signal quality, especially for low bit-rate quantisers.

15 Claims, 2 Drawing Sheets

OTHER PUBLICATIONS

Figure 4:
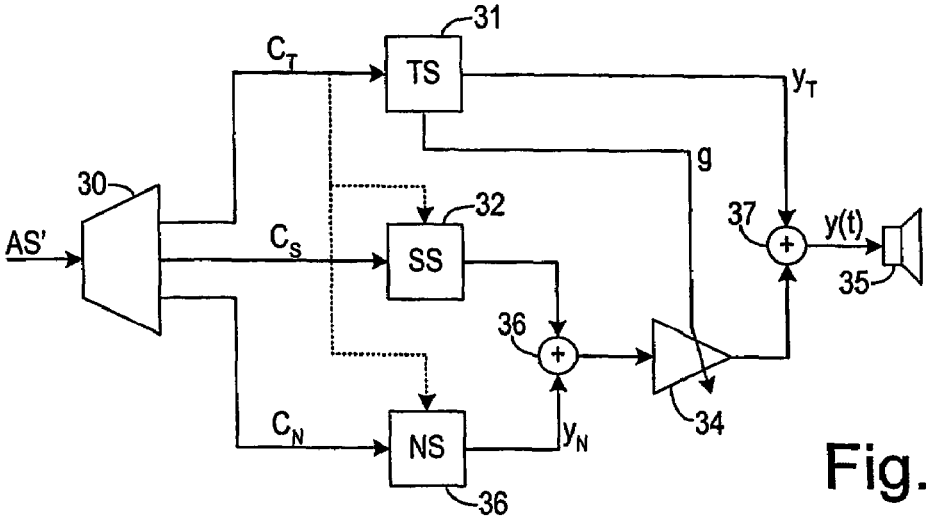

Sassan Ahmadi et al; "Miniumum-Variance Phase Prediction and Frame Interpolation Algorithms for Low Bit Rate Sinusoidal Speech Coding", ISCAS 2000, IEEE International Symposium on Circuits and Systems, May 28-31, 2000, Geneva, Swithzerland.

Hossein Najal-Zadeh et al; "Narrowband Perceptual Audio Coding: Enhancements for Speech", Eurospeech 2001, Scandinvia.

Doh-Suk Kim el al; "On the Perceptual Weighting Function for Phase Quantization of Speech", Human & Computer Interaction Lab. Samsung Advance Inst. of Technology, Kyonggi-Do, Korea, pp. 62-64, XP002171475.

* cited by examiner

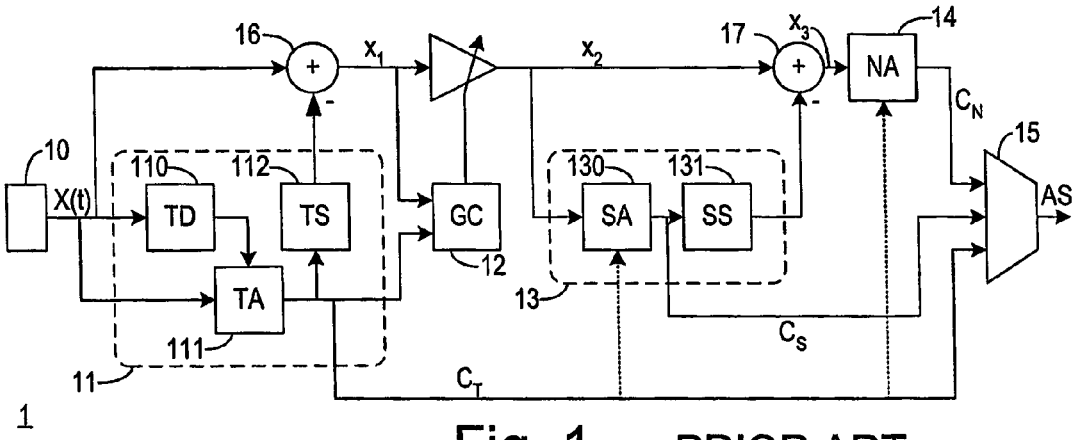
Fig. 1 - PRIOR ART
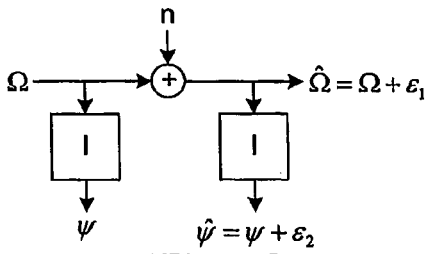
Fig. 2a
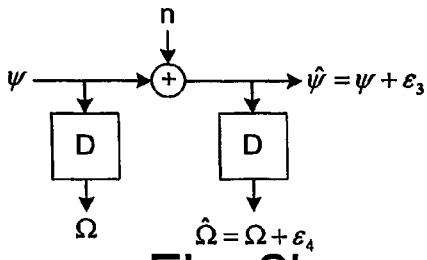
Fig. 2b
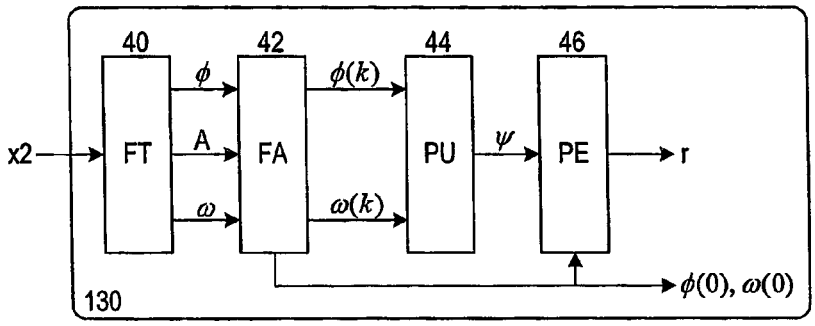
Fig. 3a
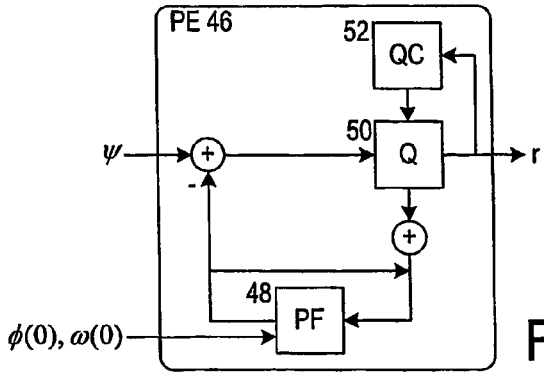
Fig. 3b

LOW BIT-RATE AUDIO ENCODING

The present invention relates to encoding and decoding of broadband signals such as particular audio signals.

When transmitting broadband signals, e.g. audio signals such as speech, compression or encoding techniques are used to reduce the bandwidth or bit rate of the signal.

FIG. 1 shows a known parametric encoding scheme, in particular a sinusoidal encoder, which is used in the present invention, and which is described in WO 01/69593. In this encoder, an input audio signal x(t) is split into several (possibly overlapping) time segments or frames, typically of duration 20 ms each. Each segment is decomposed into transient, sinusoidal and noise components. It is also possible to derive other components of the input audio signal such as harmonic complexes, although these are not relevant for the purposes of the present invention.

In the sinusoidal analyser 130, the signal x2 for each segment is modelled using a number of sinusoids represented by amplitude, frequency and phase parameters. This information is usually extracted for an analysis time interval by performing a Fourier transform (FT) which provides a spectral representation of the interval including: frequencies, amplitudes for each frequency, and phases for each frequency, where each phase is "wrapped", i.e. in the range $\{-\pi;\pi\}$. Once the sinusoidal information for a segment is estimated, a tracking algorithm is initiated. This algorithm uses a cost function to link sinusoids in different segments with each other on a segment-to-segment basis to obtain so-called tracks. The tracking algorithm thus results in sinusoidal codes $C_S$ comprising sinusoidal tracks that start at a specific time instance, evolve for a certain duration of time over a plurality of time segments and then stop.

In such sinusoidal encoding, it is usual to transmit frequency information for the tracks formed in the encoder. This can be done in a simple manner and with relatively low costs, since tracks only have slowly varying frequency. Frequency information can therefore be transmitted efficiently by time differential encoding. In general, amplitude can also be encoded differentially over time.

In contrast to frequency, phase changes more rapidly with time. If the frequency is constant, the phase will change linearly with time, and frequency changes will result in corresponding phase deviations from the linear course. As a function of the track segment index, phase will have an approximately linear behaviour. Transmission of encoded phase is therefore more complicated. However, when transmitted, phase is limited to the range $\{-\pi;\pi\}$, i.e. the phase is "wrapped", as provided by the Fourier transform. Because of this modulo $2\pi$ representation of phase, the structural inter-frame relation of the phase is lost and, at first sight appears to be a random variable.

However, since the phase is the integral of the frequency, the phase is redundant and needs, in principle, not be transmitted. This is called phase continuation and reduces the bit rate significantly.

In phase continuation, only the first sinusoid of each track is transmitted in order to save bit rate. Each subsequent phase is calculated from the initial phase and frequencies of the track. Since the frequencies are quantised and not always very accurately estimated, the continuous phase will deviate from the measured phase. Experiments show that phase continuation degrades the quality of an audio signal.

Transmitting the phase for every sinusoid increases the quality of the decoded signal at the receiver end, but it also results in a significant increase in bit rate/bandwidth. Therefore, a joint frequency/phase quantiser, in which the measured phases of a sinusoidal track having values between $-\pi$ and $\pi$ are unwrapped using the measured frequencies and linking information, results in monotonically increasing unwrapped phases along a track. In that encoder the unwrapped phases are quantised using an Adaptive Differential Pulse Code Modulation (ADPCM) quantiser and transmitted to the decoder. The decoder derives the frequencies and the phases of a sinusoidal track from the unwrapped phase trajectory.

In phase continuation, only the encoded frequency is transmitted, and the phase is recovered at the decoder from the frequency data by exploiting the integral relation between phase and frequency. It is known, however, that when phase continuation is used, the phase cannot be perfectly recovered. If frequency errors occur, e.g. due to measurement errors in the frequency or due to quantisation noise, the phase, being reconstructed using the integral relation, will typically show an error having the character of drift. This is because frequency errors have an approximately random character. Low-frequency errors are amplified by integration, and consequently the recovered phase will tend to drift away from the actually measured phase. This leads to audible artifacts.

This is illustrated in FIG. 2*a* where $\Omega$ and $\psi$ are the real frequency and real phase, respectively, for a track. In both the encoder and decoder frequency and phase have an integral relationship as represented by the letter "I". The quantisation process in the encoder is modelled as an added noise n. In the decoder, the recovered phase $\hat{\psi}$ thus includes two components: the real phase $\psi$ and a noise component $\epsilon_2$, where both the spectrum of the recovered phase and the power spectral density function of the noise $\epsilon_2$ have a pronounced low-frequency character.

Thus, it can be seen that in phase continuation, since the recovered phase is the integral of a low-frequency signal, the recovered phase is a low-frequency signal itself. However, the noise introduced in the reconstruction process is also dominant in this low-frequency range. It is therefore difficult to separate these sources with a view to filtering the noise n introduced during encoding.

In conventional quantisation methods, frequency and phase are quantised independent of each other. In general, a uniform scalar quantiser is applied to the phase parameter. For perceptual reasons the lower frequencies should be quantised more accurately than the higher frequencies. Therefore the frequencies are converted to a non-uniform representation using the ERB or Bark function and then quantised uniformly, resulting in a non-uniform quantiser. Also physical reasons can be found: in harmonic complexes, higher harmonic frequencies tend to have higher frequency variations than the lower frequencies.

When the frequency and phase are quantised jointly, frequency dependent quantisation accuracy is not straightforward. The use of a uniform quantisation approach results in a low quality sound reconstruction. Furthermore, for the high frequencies, where the quantisation accuracy can be lowered, a quantiser can be developed that needs less bits. For the unwrapped phases, a similar mechanism would be desirable.

The invention provides a method of encoding a broadband signal, in particular an audio signal such as a speech signal using a low bit-rate. In the sinusoidal encoder a number of sinusoids are estimated per audio segment. A sinusoid is represented by frequency, amplitude and phase. Normally, phase is quantised independent of frequency. The invention uses a frequency dependent quantisation of phase, and in particular the low frequencies are quantised using smaller quantisation intervals than at higher frequencies. Thus, the unwrapped phases of the lower frequencies are quantised more accurately, possibly with a smaller quantisation range, than the phases of the higher frequencies. The invention gives a significant improvement in decoded signal quality, especially for low bit-rate quantisers.

The invention enables the use of joint quantisation of frequency and phase while having a non-uniform frequency quantisation as well. This results in the advantage of transmitting phase information with a low bit rate while still maintaining good phase accuracy and signal quality at all frequencies, in particular also at low frequencies.

The advantage of this method is improved phase accuracy, in particular at the lower frequencies, where a phase error corresponds to a larger time error than at higher frequencies. This is important, since the human ear is not only sensitive to frequency and phase but also to absolute timing as in transients, and the method of the invention results in improved sound quality, especially when only a small number of bits is used for quantising the phase and frequency values. On the other hand, a required sound quality can be obtained using fewer bits. Since the low frequencies are slowly varying, the quantisation range can be more limited and a more accurate quantisation is obtained. Furthermore, the adaptation to a finer quantisation is much faster.

The invention can be used in an audio encoder where sinusoids are used. The invention relates both to the encoder and the decoder.

Figure 5A:
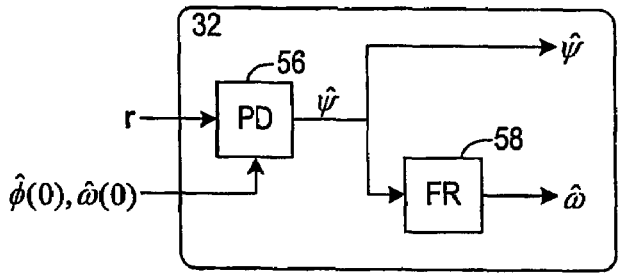
Figure 5B:
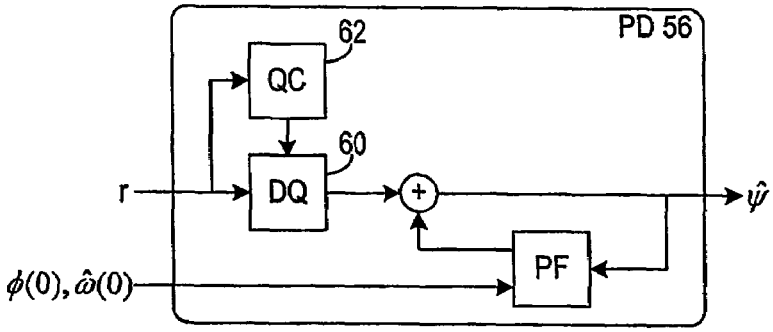
Figure 6:
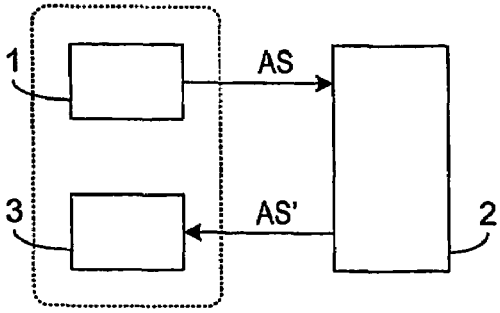

FIG. 1 shows a prior art audio encoder in which an embodiment of the invention is implemented;

FIG. 2*a* illustrates the relationship between phase and frequency in prior art systems;

FIG. 2*b* illustrates the relationship between phase and frequency in audio systems according to the present invention;

FIGS. 3*a* and 3*b* show a preferred embodiment of a sinusoidal encoder component of the audio encoder of FIG. 1;

FIG. 4 shows an audio player in which an embodiment of the invention is implemented; and FIGS. 5*a* and 5*b* show a preferred embodiment of a sinusoidal synthesizer component of the audio player of FIG. 4; and FIG. 6 shows a system comprising an audio encoder and an audio player according to the invention.

Preferred embodiments of the invention will now be described with reference to the accompanying drawings wherein like components have been accorded like reference numerals and, unless otherwise stated, perform like functions. In a preferred embodiment of the present invention, the encoder 1 is a sinusoidal encoder of the type described in WO 01/69593, FIG. 1. The operation of this prior art encoder and its corresponding decoder has been well described and description is only provided here where relevant to the present invention.

In both the prior art and the preferred embodiment of the present invention, the audio encoder 1 samples an input audio signal at a certain sampling frequency resulting in a digital representation x(t) of the audio signal. The encoder I then separates the sampled input signal into three components: transient signal components, sustained deterministic components, and sustained stochastic components. The audio encoder 1 comprises a transient encoder 11, a sinusoidal encoder 13 and a noise encoder 14.

The transient encoder 11 comprises a transient detector (TD) 110, a transient analyzer (TA) 111 and a transient synthesizer (TS) 112. First, the signal x(t) enters the transient detector 110. This detector 110 estimates if there is a transient signal component and its position. This information is fed to the transient analyzer 111. If the position of a transient signal component is determined, the transient analyzer 111 tries to extract (the main part of) the transient signal component. It matches a shape function to a signal segment preferably starting at an estimated start position, and determines content underneath the shape function, by employing for example a (small) number of sinusoidal components. This information is contained in the transient code $C_T$, and more detailed information on generating the transient code $C_T$ is provided in WO 01/69593.

The transient code $C_T$ is furnished to the transient synthesizer 112. The synthesized transient signal component is subtracted from the input signal x(t) in subtractor 16, resulting in a signal x1. A gain control mechanism GC (12) is used to produce x2 from x1.

The signal x2 is furnished to the sinusoidal encoder 13 where it is analyzed in a sinusoidal analyzer (SA) 130, which determines the (deterministic) sinusoidal components. It will therefore be seen that while the presence of the transient analyser is desirable, it is not necessary and the invention can be implemented without such an analyser. Alternatively, as mentioned above, the invention can also be implemented with for example a harmonic complex analyser. In brief, the sinusoidal encoder encodes the input signal x2 as tracks of sinusoidal components linked from one frame segment to the next.

Referring now to FIG. 3*a*, in the same manner as in the prior art, in the preferred embodiment, each segment of the input signal x2 is transformed into the frequency domain in a Fourier transform (FT) unit 40. For each segment, the FT unit provides measured amplitudes A, phases $\phi$ and frequencies $\omega$. As mentioned previously, the range of phases provided by the Fourier transform is restricted to $-\pi \leqq \phi < \pi$. A tracking algorithm (TA) unit 42 takes the information for each segment and by employing a suitable cost function, links sinusoids from one segment to the next, so producing a sequence of measured phases $\phi(k)$ and frequencies $\omega(k)$ for each track.

In contrast to the prior art, the sinusoidal codes $C_S$ ultimately produced by the analyzer 130 include phase information, and frequency is reconstructed from this information in the decoder.

As mentioned above, however, the measured phase is wrapped, which means that it is restricted to a modulo $2\pi$ representation. Therefore, in the preferred embodiment, the analyzer comprises a phase unwrapper (PU) 44 where the modulo $2\pi$ phase representation is unwrapped to expose the structural inter-frame phase behaviour $\psi$ for a track. As the frequency in sinusoidal tracks is nearly constant, it will be seen that the unwrapped phase $\psi$ will typically be a nearly linearly increasing (or decreasing) function and this makes cheap transmission of phase, i.e. with low bit rate, possible. The unwrapped phase $\psi$ is provided as input to a phase encoder (PE) 46 which provides as output quantised representation levels r suitable for being transmitted.

Referring now to the operation of the phase unwrapper 44, as mentioned above, instantaneous phase $\psi$ and instantaneous frequency $\Omega$ for a track are related by:

$$\psi(t)=\int_{T_0}^{t}\Omega(\tau)d\tau+\psi(T_0) \tag{1}$$

where $T_0$ is a reference time instant.

A sinusoidal track in frames k=K, K+1 . . . K+L−1 has measured frequencies $\omega(k)$ (expressed in radians per second) and measured phases $\phi(k)$ (expressed in radians). The distance between the centres of the frames is given by U (update rate expressed in seconds). The measured frequencies are supposed to be samples of the assumed underlying continuous-time frequency track $\Omega$ with $\omega(k)=\Omega(kU)$ and, similarly, the measured phases are samples of the associated continuous-time phase track $\psi$ with $\phi(k)=\psi(kU) \bmod (2\pi)$. For sinusoidal encoding it is assumed that $\Omega$ is a nearly constant function.

Assuming that the frequencies are nearly constant within a segment Equation 1 can be approximated as follows:

$$\psi(kU) = \int_{(k-1)U}^{kU} \Omega(\tau)d\tau + \psi((k-1)U) \approx \{\omega(k) + \omega(k-1)\}U/2 + \psi((k-1)U) \tag{2}$$

It will therefore be seen that knowing the phase and frequency for a given segment and the frequency of the next segment, it is possible to estimate an unwrapped phase value for the next segment, and so on for each segment in a track.

In the preferred embodiment, the phase unwrapper determines an unwrap factor m(k) at time instant k:

$$\psi(kU)=\phi(k)+m(k)2\pi \tag{3}$$

The unwrap factor m(k) tells the phase unwrapper 44 the number of cycles which has to be added to obtain the unwrapped phase.

Combining equations 2 and 3, the phase unwrapper determines an incremental unwrap factor e(k) as follows:

$$2\pi e(k)=2\pi\{m(k)-m(k-1)\}=\{\omega(k)+\omega(k-1)\}U/2-\{\phi(k)-\phi(k-1)\}$$

where e should be an integer. However, due to measurement and model errors, the incremental unwrap factor will not be an integer exactly, so:

$$e(k)=\text{round}([\{\omega(k)+\omega(k-1)\}U/2-\{\phi(k)-\phi(k-1)\}]/(2\pi))$$

assuming that the model and measurement errors are small.

Having the incremental unwrap factor e, the m(k) from equation (3) is calculated as the cumulative sum where, without loss of generality, the phase unwrapper starts in the first frame K with m(K)=0, and from m(k) and $\phi(k)$, the (unwrapped) phase $\psi(kU)$ is determined.

In practice, the sampled data $\psi(kU)$ and $\Omega(kU)$ are distorted by measurement errors:

$$\phi(k)=\psi(kU)+\epsilon_1(k),$$

$$\omega(k)=\Omega(kU)+\epsilon_2(k),$$

where $\epsilon_1$ and $\epsilon_2$ are the phase and frequency errors, respectively. In order to prevent the determination of the unwrap factor becoming ambiguous, the measurement data needs to be determined with sufficient accuracy. Thus, in the preferred embodiment, tracking is restricted so that:

$$\delta(k)=e(k)-[\{\omega(k)+\omega(k-1)\}U/2-\{\phi(k)-\phi(k-1)\}]/(2\pi) < \delta_0$$

where $\delta$ is the error in the rounding operation. The error $\delta$ is mainly determined by the errors in $\omega$ due to the multiplication with U. Assume that $\omega$ is determined from the maxima of the absolute value of the Fourier transform from a sampled version of the input signal with sampling frequency $F_s$ and that the resolution of the Fourier transform is $2\pi/L_a$ with $L_a$ the analysis size. In order to be within the considered bound, we have:

$$\frac{L_a}{U} = \delta_0$$

That means that the analysis size should be few times larger than the update size in order for unwrapping to be accurate, e.g., setting $\delta_0=1/4$, the analysis size should be four times the update size (neglecting the errors $\epsilon_1$ in the phase measurement).

The second precaution which-can be taken to avoid decision errors in the round operation is to defining tracks appropriately. In the tracking unit 42, sinusoidal tracks are typically defined by considering amplitude and frequency differences. Additionally, it is also possible to account for phase information in the linking criterion. For instance, we can define the phase prediction error E as the difference between the measured value and the predicted value $\tilde{\phi}$ according to $$\epsilon=\{\phi(k)-\tilde{\phi}(k)\} \bmod 2\pi$$

where the predicted value can be taken as $$\tilde{\phi}(k)=\phi(k-1)+\{\omega(k)-\omega(k-1)\}U/2$$

Thus, preferably the tracking unit 42 forbids tracks where $\epsilon$ is larger than a certain value (e.g. $\epsilon>\pi/2$), resulting in an unambiguous definition of e(k).

Additionally, the encoder may calculate the phases and frequencies such as will be available in the decoder. If the phases or frequencies which will become available in the decoder differ too much from the phases and/or frequencies such as are present in the encoder, it may be decided to interrupt a track, i.e. to signal the end of a track and start a new one using the current frequency and phase and their linked sinusoidal data.

The sampled unwrapped phase $\psi(kU)$ produced by the phase unwrapper (PU) 44 is provided as input to phase encoder (PE) 46 to produce the set of representation levels r. Techniques for efficient transmission of a generally monotonically changing characteristic such as the unwrapped phase are known. In the preferred embodiment, FIG. 3*b*, Adaptive Differential Pulse Code Modulation (ADPCM) is employed. Here, a predictor (PF) 48 is used to estimate the phase of the next track segment and encode the difference only in a quantizer (Q) 50. Since $\psi$ is expected to be a nearly linear function and for reasons of simplicity, the predictor 48 is chosen as a second-order filter of the form:

$$y(k+1)=2x(k)-x(k-1)$$

where x is the input and y is the output. It will be seen, however, that it is also possible to take other functional relations (including higher-order relations) and to include adaptive (backward or forward) adaptation of the filter coefficients. In the preferred embodiment, a backward adaptive control mechanism (QC) 52 is used for simplicity to control the quantiser 50. Forward adaptive control is also possible as well but would require extra bit rate overhead.

As will be seen, initialization of the encoder (and decoder) for a track starts with knowledge of the start phase $\phi(\mathbf{0})$ and frequency $\omega(\mathbf{0})$. These are quantized and transmitted by a separate mechanism. Additionally, the initial quantization step used in the quantization controller 52 of the encoder and the corresponding controller 62 in the decoder, FIG. 5*b*, is either transmitted or set to a certain value in both encoder and decoder. Finally, the end of a track can either be signalled in a separate side stream or as a unique symbol in the bit stream of the phases.

The start frequency of the unwrapped phase is known, both in the encoder and in the decoder. On basis of this frequency, the quantisation accuracy is chosen. For the unwrapped phase trajectories beginning with a low frequency, a more accurate quantisation grid, i.e. a higher resolution, is chosen than for an unwrapped phase trajectory beginning with a higher frequency.

In the ADPCM quantiser, the unwrapped phase $\psi(k)$, where k represents the number in the track, is predicted/estimated from the preceding phases in the track. The difference between the predicted phase $\tilde{\psi}(k)$ and the unwrapped phase $\psi(k)$ is then quantised and transmitted. The quantiser is adapted for every unwrapped phase in the track. When the prediction error is small, the quantiser limits the range of possible values and the quantisation can become more accurate. On the other hand, when the prediction error is large, the quantiser uses a coarser quantisation.

The quantiser Q (in FIG. 3*b*) quantises the prediction error $\Delta$, which is calculated by $$\Delta(k)=\psi(k)-\tilde{\psi}(k)$$

The prediction error $\Delta$ can be quantised using a look-up table. For this purpose, a table Q is maintained. For example, for a 2-bit ADPCM quantiser, the initial table for Q may look like the table shown in Table 1.

TABLE 1

Quantisation table Q used for first continuation.

| Index i | Lower boundaries bl | Upper boundary bu |
|---|---|---|
| 0 | $-\infty$ | −3.0 |
| 1 | −3.0 | 0 |
| 2 | 0 | 3.0 |
| 3 | 3.0 | $\infty$ |

The quantisation is done as follows. The prediction error $\Delta$ is compared to the boundaries b, such that the following equation is satisfied:

$$bl_i<\Delta\leq bu_i$$

From the value of i, that satisfies the above relation, the representation level r is computed by r=i.

The associated representation levels are stored in representation table R, which is shown in Table 2.

TABLE 2

Representation table R used for first continuation

| Representation level r | Representation table R | Level type |
|---|---|---|
| 0 | −3.0 | Outer level |
| 1 | −0.75 | Inner level |
| 2 | 0.75 | Inner level |
| 3 | 3.0 | Outer level |

The entries of tables Q and are multiplied by factor c for the quantisation of the next sinusoidal component in the track.

$$Q(k+1)=Q(k)\cdot c$$

$$R(k+1)=R(k)\cdot c$$

During the decoding of a track, both tables are scaled according to the generated representation levels r. If r is either 1 or 2 (inner level) for the current sub-frame, then the scale factor c for the quantisation table is set to $$c=2^{-1/4}$$

Since c<1, the frequency and phase of the next sinusoid in a track becomes more accurate. If r is 0 or 3 (outer level), the scale factor is set to $$c=2^{1/2}$$

Since c>1, the quantisation accuracy for the next sinusoid in a track decreases. Using these factors, one up-scaling can be made undone by two down-scalings. The difference in upscale and downscale factors results in a fast onset of an upscaling, whereas a corresponding downscaling requires two steps.

In order to avoid very small or very large entries in the quantisation table, the adaptation is only done if the absolute value of the inner level is between $\pi/64$ and $3\pi/4$. In that case c is set to 1.

In the decoder only table R has to be maintained to convert to received representation levels r to a quantised prediction error. This de-quantisation operation is performed by block DQ in FIG. 5*b*.

Using the above settings, the quality of the reconstructed sound needs improvement. In accordance with the invention, different initial tables for unwrapped phase tracks, depending on the start frequency, are used. Hereby a better sound quality is obtained. This is done as follows. The initial tables Q and R are scaled on basis a first frequency of the track. In Table 3, the scale factors are given together with the frequency ranges. If the first frequency of a track lies in a certain frequency range, the appropriate scale factor is selected, and the tables R and Q are divided by that scale factor. The end-points can also depend on the first frequency of the track. In the decoder, a corresponding procedure is performed in order to start with the correct initial table R.

TABLE 3

Frequency dependent scale factors and initial tables

| Frequency range | Scale factor | Initial table Q | Initial table R |
|---|---|---|---|
| 0-500 Hz | 8 | $-\infty$ −0.19 0 0.19 $\infty$ | −0.38 −0.09 0.09 0.38 |
| 500-1000 Hz | 4 | $-\infty$ −0.37 0 0.37 $\infty$ | −0.75 −0.19 0.19 0.75 |
| 1000-4000 Hz | 2 | $-\infty$ −0.75 0 0.75 $\infty$ | −1.5 −0.38 0.38 1.5 |
| 4000-22050 Hz | 1 | $-\infty$ −1.5 0 1.5 $\infty$ | −3 −0.75 0.75 3 |

Table 3 shows an example of frequency dependent scale factors and corresponding initial tables Q and R for a 2-bit ADPCM quantiser. The audio frequency range 0-22050 Hz is divided into four frequency sub-ranges. It is seen that the phase accuracy is improved in the lower frequency ranges relative to the higher frequency ranges.

The number of frequency sub-ranges and the frequency dependent scale factors may vary and can be chosen to fit the individual purpose and requirements. Like described above, the frequency dependent initial tables Q and R in table 3 may be up-scaled and down-scaled dynamically to adapt to the evolution in phase from one time segment to the next.

In e.g. a 3-bit ADPCM quantiser, the initial boundaries of the eight quantisation intervals defined by the 3 bits can be defined as follows:

Q={$-\infty$−1.41−0.707−0.35 0 0.35 0.707 1.41 $\infty$}, and can have minimum grid size $\pi/64$, and a maximum grid size $\pi/2$. The representation table R may look like:

R={−2.117, −1.0585, −0.5285, −0.1750, 0.1750, 0.5285, 1.0585, 2.117}. A similar frequency dependent initialisation of the table Q and R as shown in Table 3 may be used in this case.

From the sinusoidal code $C_S$ generated with the sinusoidal encoder, the sinusoidal signal component is reconstructed by a sinusoidal synthesizer (SS) 131 in the same manner as will be described for the sinusoidal synthesizer (SS) 32 of the decoder. This signal is subtracted in subtractor 17 from the input x2 to the sinusoidal encoder 13, resulting in a remaining signal x3. The residual signal x3 produced by the sinusoidal encoder 13 is passed to the noise analyzer 14 of the preferred embodiment which produces a noise code $C_N$ representative of this noise, as described in, for example, international patent application No. PCT/EP00/04599.

Finally, in a multiplexer 15, an audio stream AS is constituted which includes the codes $C_T$, $C_S$ and $C_N$. The audio stream AS is furnished to e.g. a data bus, an antenna system, a storage medium etc.

FIG. 4 shows an audio player 3 suitable for decoding an audio stream AS', e.g. generated by an encoder 1 of FIG. 1, obtained from a data bus, antenna system, storage medium etc. The audio stream AS' is de-multiplexed in a de-multiplexer 30 to obtain the codes $C_T$, $C_S$ and $C_N$. These codes are furnished to a transient synthesizer 31, a sinusoidal synthesizer 32 and a noise synthesizer 33 respectively. From the transient code $C_T$, the transient signal components are calculated in the transient synthesizer 31. In case the transient code indicates a shape function, the shape is calculated based on the received parameters. Further, the shape content is calculated based on the frequencies and amplitudes of the sinusoidal components. If the transient code $C_T$ indicates a step, then no transient is calculated. The total transient signal $y_T$ is a sum of all transients.

The sinusoidal code $C_S$ including the information encoded by the analyser 130 is used by the sinusoidal synthesizer 32 to generate signal $y_S$. Referring now to FIGS. 5*a* and *b*, the sinusoidal synthesizer 32 comprises a phase decoder (PD) 56 compatible with the phase encoder 46. Here, a de-quantiser (DQ) 60 in conjunction with a second-order prediction filter (PF) 64 produces (an estimate of) the unwrapped phase $\hat{\psi}$ from: the representation levels r; initial information $\hat{\phi}(\mathbf{0})$, $\hat{\omega}(\mathbf{0})$ provided to the prediction filter (PF) 64 and the initial quantization step for the quantization controller (QC) 62.

As illustrated in FIG. 2*b*, the frequency can be recovered from the unwrapped phase $\hat{\psi}$ by differentiation. Assuming that the phase error at the decoder is approximately white and since differentiation amplifies the high frequencies, the differentiation can be combined with a low-pass filter to reduce the noise and, thus, to obtain an accurate estimate of the frequency at the decoder.

In the preferred embodiment, a filtering unit (FR) 58 approximates the differentiation which is necessary to obtain the frequency $\hat{\omega}$ from the unwrapped phase by procedures as forward, backward or central differences. This enables the decoder to produce as output the phases $\hat{\psi}$ and frequencies $\hat{\omega}$ usable in a conventional manner to synthesize the sinusoidal component of the encoded signal.

At the same time, as the sinusoidal components of the signal are being synthesized, the noise code $C_N$ is fed to a noise synthesizer NS 33, which is mainly a filter, having a frequency response approximating the spectrum of the noise. The NS 33 generates reconstructed noise $y_N$ by filtering a white noise signal with the noise code $C_N$. The total signal y(t) comprises the sum of the transient signal $y_T$ and the product of any amplitude decompression (g) and the sum of the sinusoidal signal $y_S$ and the noise signal $y_N$. The audio player comprises two adders 36 and 37 to sum respective signals. The total signal is furnished to an output unit 35, which is e.g. a speaker.

FIG. 6 shows an audio system according to the invention comprising an audio encoder 1 as shown in FIG. 1 and an audio player 3 as shown in FIG. 4. Such a system offers playing and recording features. The audio stream AS is furnished from the audio encoder to the audio player over a communication channel 2, which may be a wireless connection, a data 20 bus or a storage medium. In case the communication channel 2 is a storage medium, the storage medium may be fixed in the system or may also be a removable disc, memory stick etc. The communication channel 2 may be part of the audio system, but will however often be outside the audio system.

The coded data from several consecutive segments are linked. This is done as follows. For each segment a number of sinusoids are determined (for example using an FFT). A sinusoid consists of a frequency, amplitude and phase. The number of sinusoids is variable per segment. Once the sinusoids are determined for a segment, an analysis is done to connect to sinusoids from the previous segment. This is called 'linking' or 'tracking'. The analysis is based on the difference between a sinusoid of the current segment and all sinusoids from the previous segment. A link/track is made with the sinusoid in the previous segment that has the smallest difference. If even the smallest difference is larger than a certain threshold value, no connection to sinusoids of the previous segment is made. In this way a new sinusoid is created or "born".

The difference between sinusoids is determined using a 'cost function', which uses the frequency, amplitude and phase of the sinusoids. This analysis is performed for each segment. The result is a large number of tracks for an audio signal. A track has a birth, which is a sinusoid that has no connection with sinusoids from the previous segment. A birth sinusoid is encoded non-differentially. Sinusoids that are connected to sinusoids from previous segments are called continuations and they are encoded differentially with respect to the sinusoids from the previous segment. This saves a lot of bits, since only differences are encoded and not absolute values.

If f(n−1) is the frequency from a sinusoid from the previous segment and f(n) is a connected sinusoid from the current segment, then f(n)−f(n+1) is transmitted to the decoder. The number n represents the number in the track, n=1 is the birth, n=2 is the first continuations etc. The same is true for the amplitudes. The phase value of the initial sinusoid (=birth sinusoid) is transmitted, whereas for a continuation, no phase is transmitted, but the phase can be retrieved from the frequencies. If a track has no continuation in the next segment, the track ends or "dies".

The invention claimed is:

1. A method of encoding a signal, the method comprising the steps of:

providing a respective set of sampled signal values (x(t)) for each of a plurality of sequential segments;

analyzing the sampled signal values (x(t)) to determine one or more sinusoidal components for each of the plurality of sequential segments, each sinusoidal component including a frequency value (Ω) and a phase value (Ψ);

linking sinusoidal components across a plurality of sequential segments to provide sinusoidal tracks;

determining, for each sinusoidal track in each of the plurality of sequential segments, a predicted phase value ($\tilde{\psi}(k)$) as a function of phase value for at least a previous segment;

determining, for each sinusoidal track, a measured phase value ($\Psi$) comprising a generally monotonically changing value;

quantizing sinusoidal codes ($C_S$) as a function of the predicted phase value ($\tilde{\psi}(k)$) and the measured phase value ($\Psi$) for the segment where the sinusoidal codes ($C_S$) are quantized in dependence on at least one frequency value ($\Omega$) of the respective sinusoidal track, wherein, in a first sinusoidal track including a first sinusoidal component with a first frequency value the sinusoidal codes ($C_S$) are quantized using a first quantization accuracy, and in a second sinusoidal track including a second sinusoidal component with a second frequency value higher than the first frequency value, the sinusoidal codes ($C_S$) are quantized using a second quantization accuracy lower than or equal to the first quantization accuracy; and generating an encoded signal (AS) including sinusoidal codes ($C_S$) representing the frequency and the phase and linking information.

2. The method as claimed in claim 1, wherein the sinusoidal codes ($C_S$) for a track include an initial phase value and an initial frequency value, and the predicting step employs the initial frequency value and the initial phase value to provide a first prediction.

3. The method as claimed in claim 1, wherein the phase value of each linked segment is determined as a function of: the integral of the frequency for the previous segment and the frequency of the linked segment; and the phase of a previous segment, wherein the sinusoidal components include a phase value ($\Psi$) in the range $\{-\pi;\pi\}$.

4. The method as claimed in claim 3, wherein the generating step comprises:

controlling the quantizing step as a function of the quantized sinusoidal codes ($C_S$).

5. The method as claimed in claim 4, wherein the sinusoidal codes ($C_S$) include an indicator of an end of a track.

6. The method as claimed in claim 1, wherein the quantizing of the sinusoidal codes includes:

determining a phase difference between each predicted phase value ($\tilde{\psi}(k)$) and the corresponding observed phase value ($\Psi$).

7. The method as claimed in claim 1, wherein the method further comprises the steps of:

synthesizing the sinusoidal components using the sinusoidal codes ($C_S$);

subtracting the synthesized signal values from the sampled signal values ($x(t)$) to provide a set of values ($x_3$) representing a remainder component of the audio signal;

modelling the remainder component of the audio signal by determining parameters, approximating the remainder component; and including the parameters in an audio stream (AS).

8. The method as claimed in claim 1, wherein the sampled signal values ($x_1$) represent an audio signal from which transient components have been removed.

9. A method of decoding an audio stream (AS') including sinusoidal codes ($C_S$) representing frequency and phase and linking information, the method comprising the steps of:

receiving a signal including the audio stream (AS');

de-quantizing the sinusoidal codes ($C_S$) thereby obtaining an unwrapped de-quantized phase value ($\hat{\Psi}$), where the sinusoidal codes ($C_S$) are de-quantized in dependence on at least one frequency value, wherein in a first sinusoidal track including a first sinusoidal component with a first frequency value the sinusoidal codes are de-quantized using a first quantization accuracy, and in a second sinusoidal track including a second sinusoidal component with a second frequency value higher than the first frequency value, the sinusoidal codes are de-quantized using a second quantization accuracy lower than or equal to the first quantization accuracy;

calculating a frequency value ($\hat{\Omega}$) from the de-quantized unwrapped phase values ($\Psi$), and employing the de-quantized frequency and phase values ($\hat{\Omega}$, $\hat{\Psi}$) to synthesize the sinusoidal components of the audio signal ($y(t)$).

10. The method as claimed in claim 9, wherein the phase value of each linked sinusoidal component is determined as a function of the integral of the frequency for the previous segment and the frequency of the linked segment; the phase of a previous segment, and wherein the sinusoidal components include a phase value in the range $\{-\pi;\pi\}$.

11. The method as claimed in claim 10, wherein the quantizing accuracy is controlled as a function of the quantized sinusoidal codes.

12. An audio encoder arranged to process a respective set of sampled signal values for each of a plurality of sequential segments, the audio encoder comprising;

an analyzer for analyzing the sampled signal values to determine one or more sinusoidal components for each of the plurality of sequential segments, each sinusoidal component including a frequency value and a phase value;

a linker (13) for linking sinusoidal components across a plurality of sequential segments to provide sinusoidal tracks;

a phase unwrapper (44) for determining, for each sinusoidal track in each of the plurality of sequential segments, a predicted phase value ($\tilde{\psi}(k)$) as a function of phase value for at least a previous segment and for determining, for each sinusoidal track, a measured phase value ($\Psi$) comprising a generally monotonically changing value;

a quantizer (50) for quantizing sinusoidal codes as a function of the predicted phase value ($\tilde{\psi}(k)$) and the measured phase value ($\Psi$) for the segment where the sinusoidal codes are quantized in dependence on at least one frequency value of the respective sinusoidal track, wherein the quantizer (50) is adapted, in a first sinusoidal track including a first sinusoidal component with a first frequency value, to quantize the sinusoidal codes ($C_S$) using a first quantization accuracy, and in a second sinusoidal track including a second sinusoidal component with a second frequency value higher than the first frequency value, to quantize the sinusoidal codes ($C_S$) using a second quantization accuracy lower than or equal to the first quantization accuracy; and means (15) for providing an encoded signal including sinusoidal codes ($C_S$) representing the frequency and the phase.

13. An audio system comprising an audio encoder as claimed in claim 12, and an audio player comprising:

means for reading an encoded audio signal including sinusoidal codes representing a frequency and a phase for each track of linked sinusoidal components;

a de-quantizer for generating phase values and for generating frequency values from the phase values; and a synthesizer arranged to employ the generated phase and frequency values to synthesize the sinusoidal components of the audio signal.

14. An audio player comprising:

means for reading an encoded audio signal including sinusoidal codes representing a frequency and a phase for each track of linked sinusoidal components, a de-quantizer for generating phase values and for generating frequency values from the phase values, wherein in a first sinusoidal track including a first sinusoidal component with a first frequency value the sinusoidal codes are de-quanitzed using a first quantization accuracy, and in a second sinusoidal track including a second sinusoidal component with a second frequency value higher than the first frequency value, the sinusoidal codes are de-quantized using a second quantization accuracy lower than or equal to the first quantization accuracy; and a synthesizer arranged to employ the generated phase and frequency values to synthesize the sinusoidal components of the audio signal.

15. A computer readable storage medium including an audio stream comprising sinusoidal codes representing tracks of sinusoidal components linked across a plurality of sequential segments of an audio signal, the codes representing a predicted phase value as a function of phase value for at least a previous segment a measured phase value comprising a generally monotonically changing value, the sinusoidal codes ($C_S$) being quantized as a function of the predicted phase value ($\tilde{\psi}(k)$) and the measured phase value ($\Psi$) for the segment where the sinusoidal codes ($C_S$) are quantized in dependence on at least one frequency value ($\Omega$) of the respective sinusoidal track, wherein in a first sinusoidal track including a first sinusoidal component with a first frequency value the sinusoidal codes are quanitzed using a first quantization accuracy, and in a second sinusoidal track including a second sinusoidal component with a second frequency value higher than the first frequency value, the sinusoidal codes are quantized using a second quantization accuracy lower than or equal to the first quantization accuracy.

* * * * *